US009511391B2

(12) United States Patent
Adam

(10) Patent No.: US 9,511,391 B2
(45) Date of Patent: Dec. 6, 2016

(54) FLUID PRODUCT TANK

(71) Applicant: APTAR FRANCE SAS, Le Neubourg (FR)

(72) Inventor: Fabien Adam, Aviron (FR)

(73) Assignee: APTAR FRANCE SAS, Le Neubourg (FR)

( * ) Notice: Subject to any disclaimer, the term of this patent is extended or adjusted under 35 U.S.C. 154(b) by 0 days.

(21) Appl. No.: 14/433,437

(22) PCT Filed: Nov. 8, 2013

(86) PCT No.: PCT/FR2013/052673
§ 371 (c)(1),
(2) Date: Apr. 3, 2015

(87) PCT Pub. No.: WO2014/072649
PCT Pub. Date: May 15, 2014

(65) Prior Publication Data

US 2015/0239003 A1 Aug. 27, 2015

(30) Foreign Application Priority Data

Nov. 12, 2012 (FR) ..... 12 60704

(51) Int. Cl.
*B05B 11/02* (2006.01)
*B05C 17/01* (2006.01)
(Continued)

(52) U.S. Cl.
CPC ..... *B05C 17/0146* (2013.01); *B05B 11/0048* (2013.01); *B05C 17/00516* (2013.01);
(Continued)

(58) Field of Classification Search
CPC ..... B05C 17/0146; B05C 17/00516; B05C 17/00569; B05C 11/0048; B05C 11/037; B05D 2539/003; B05D 83/0033
(Continued)

(56) References Cited

U.S. PATENT DOCUMENTS 5,647,510 A * 7/1997 Keller ..... B05C 17/00513 222/105
6,499,898 B1 12/2002 Garcia
(Continued)

FOREIGN PATENT DOCUMENTS

DE 37 38 792 A1 4/1989
DE 0 363 307 A1 4/1990
(Continued)

OTHER PUBLICATIONS

International Preliminary Report on Patentability dated May 21, 2015, issued by the International Bureau in corresponding International Application No. PCT/FR2013/052673.
(Continued)

*Primary Examiner* — J. Gregory Pickett
*Assistant Examiner* — Niki M Eloshway
(74) *Attorney, Agent, or Firm* — Sughrue Mion, PLLC

(57) ABSTRACT

A fluid reservoir comprising:
a slide cylinder (11);
a neck (12) that defines an outlet opening (13);
an internal shoulder (14) that connects the slide cylinder (11) to the outlet opening (13), the internal shoulder (14) being provided with an annular groove (15) that extends in line with the slide cylinder (11), such that the internal shoulder (14) defines an annular collar (16) that connects the annular groove (15) to the outlet opening (13); and
a follower piston (2) that is engaged to slide in leaktight manner in the slide cylinder (11), the piston (2) defining
(Continued)

Figure 1A:
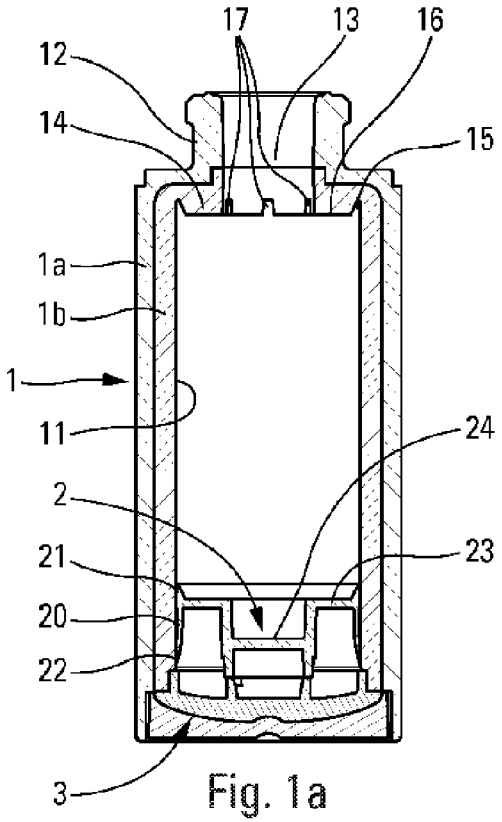

at least one sealing lip (21) that is received in the annular groove (15) when the reservoir is empty;

the fluid reservoir being characterized in that the annular collar (16) is formed with at least one radial channel (17; 17') that connects the annular groove (15) to the outlet opening (13) of the neck (11).

11 Claims, 2 Drawing Sheets

(51) Int. Cl.

| | |
|---|---|
| ***B65D 83/00*** | (2006.01) |
| ***B05C 17/005*** | (2006.01) |
| *B65D 83/76* | (2006.01) |
| *B05B 11/00* | (2006.01) |

(52) U.S. Cl.
CPC .... *B05C 17/00569* (2013.01); *B65D 83/0033* (2013.01); *B05B 11/0037* (2013.01); *B65D 2539/003* (2013.01)

(58) Field of Classification Search
USPC ..... 222/631, 249, 384; 220/345.1
See application file for complete search history.

(56) References Cited

U.S. PATENT DOCUMENTS

| | | | | |
|---|---|---|---|---|
| 2008/0023491 | A1* | 1/2008 | Rousselet | A45D 40/0068 222/256 |
| 2010/0147895 | A1* | 6/2010 | Helmenstein | B05C 17/00576 222/326 |
| 2012/0267398 | A1* | 10/2012 | Lim | A45D 34/04 222/256 |
| 2012/0267399 | A1* | 10/2012 | Moretti | B05B 11/3008 222/321.2 |

FOREIGN PATENT DOCUMENTS

| | | |
|---|---|---|
| DE | 100 17 438 A1 | 10/2001 |
| DE | 101 21 381 C1 | 10/2002 |

OTHER PUBLICATIONS

International Search Report for PCT/FR2013/052673 dated Mar. 4, 2014 [PCT/ISA/210].

* cited by examiner

FLUID PRODUCT TANK

CROSS REFERENCE TO RELATED APPLICATIONS

This application is a National Stage of International Application No. PCT/FR2013/052673 filed Nov. 8, 2013, claiming priority based on French Patent Application No. 12 60704 filed Nov. 12, 2012, the contents of all of which are incorporated herein by reference in their entirety.

The present invention relates to a reservoir comprising: a slide cylinder; a neck that defines an outlet opening; an internal shoulder that connects the slide cylinder to the outlet opening; and a follower piston that is engaged to slide in leaktight manner in the slide cylinder, the piston defining at least one leaktight sliding lip. This type of reservoir is frequently used in the field of cosmetics, or more generally for storing fluids that are sensitive or fragile. Specifically, this type of follower-piston reservoir makes it possible to store the fluid, without the fluid ever being in contact with air. This is possible given that the movement of the follower piston serves to vary the working volume of the reservoir as the fluid is extracted therefrom. Advantageously, by using a dispenser member without intake of air, i.e. an "airless" dispenser member, it is guaranteed that the fluid stored in the reservoir is never in contact with air.

A conventional problem inherent with the follower piston resides in the fact that it is difficult to extract all of the fluid stored in the reservoir. Specifically, as a result of the configuration of the follower piston, of the shoulder of the reservoir, and of the dispenser member (pump), it is practically impossible to empty the reservoir completely. The term "fluid restitution" or "degree of restitution" is used to characterize the ability of the reservoir to be emptied more or less completely.

An object of the present invention is to increase this degree of restitution by minimizing, as much as possible, the volume of fluid that remains stored in the reservoir when the follower piston has finished its stroke.

Another problem that occurs with follower-piston reservoirs is associated with vacuum packaging. Specifically, when the reservoir is filled, air pockets often form below the internal shoulder in the proximity of the slide cylinder. This can easily be explained by the fact that, at this location, the reservoir forms a zone that is difficult to fill, in particular because of gravity. During vacuum packaging, the fluid-filled reservoir is subjected to suction to a greater or lesser extent, for the purpose of removing the air from the reservoir. When an air pocket is present below the internal shoulder, putting the reservoir under suction causes the volume of the air pocket to expand, consequently causing fluid to rise quickly in the opening of the neck. As a result, the fluid sometimes spurts out of the neck and soils the outside of the reservoir, which naturally is unacceptable.

Another object of the present invention is to remedy the above-mentioned drawback associated with vacuum packaging the reservoir.

To achieve the various objects, the present invention proposes a fluid reservoir comprising: a slide cylinder; a neck that defines an outlet opening; an internal shoulder that connects the slide cylinder to the outlet opening, the internal shoulder being provided with an annular groove that extends in line with the slide cylinder, such that the internal shoulder defines an annular collar that connects the annular groove to the outlet opening; and a follower piston that is engaged to slide in leaktight manner in the slide cylinder, the piston defining at least one sealing lip that is received in the annular groove when the reservoir is empty; the annular collar being formed with at least one radial channel that connects the annular groove to the outlet opening of the neck.

Advantageously, the annular collar includes a plurality of radial channels. The radial channels that connect the slide cylinder to the outlet opening of the neck at the internal shoulder make it possible to exhaust any air pockets that might be formed below the shoulder while filling the reservoir. The radial channels are particularly useful when the reservoir is provided with an annular groove for receiving the top lip of the piston, given that the annular groove encourages the formation of pockets of air. Real synergy thus exists between the annular groove and the radial channels, making it possible firstly to increase the degree of restitution of the reservoir, and secondly to exhaust any air that might be held captive below the shoulder and in the annular groove. Advantageously, the groove and said at least one channel present respective bottoms that are connected together in continuous manner. Thus, the groove communicates directly and without discontinuity with the channel, thereby making it possible to optimize exhausting of any air that might be held captive. According to another advantageous characteristic, the bottom of said at least one channel extends in sloping manner towards the high end of the groove, towards the opening. In this way, any air that might be held captive can also be exhausted very easily towards the outside of the neck. According to another characteristic of the invention, said at least one channel presents a section that is trapezoidal or triangular. This configuration makes it possible to encourage exhausting of any air that might be held captive, while limiting the total combined volume of the channels, and this increases the degree of restitution.

Advantageously, the follower piston includes a disk, the lip projecting from the disk such that the disk is in contact with the collar when the lip is received in the groove. This also makes it possible to increase still further the degree of restitution of the reservoir, minimizing its dead volume as much as possible. According to another advantageous characteristic, the follower piston includes a central cup that extends substantially in register with the outlet opening of the neck, so as to receive a bottom portion of a pump or of a valve. In a practical and conventional embodiment, the follower piston includes a bottom lip and a top lip for sliding in leaktight manner in the cylinder, the top lip being received in the groove when the reservoir is empty. Preferably, the annular groove presents a section of shape that is substantially similar to the shape of the lip.

The spirit of the invention resides in optimizing the degree of restitution of the follower-piston reservoir by forming a housing for receiving the top lip of the follower piston at the end of the stoke of said follower piston. However, this characteristic encourages pockets of air to form while the reservoir is being filled, but the air from the pockets is exhausted by the presence of radial channels that connect the annular groove to the outlet opening of the neck.

The invention is described more fully below with reference to the accompanying drawings that show two embodiments of the invention by way of non-limiting example.

Figure 1B:
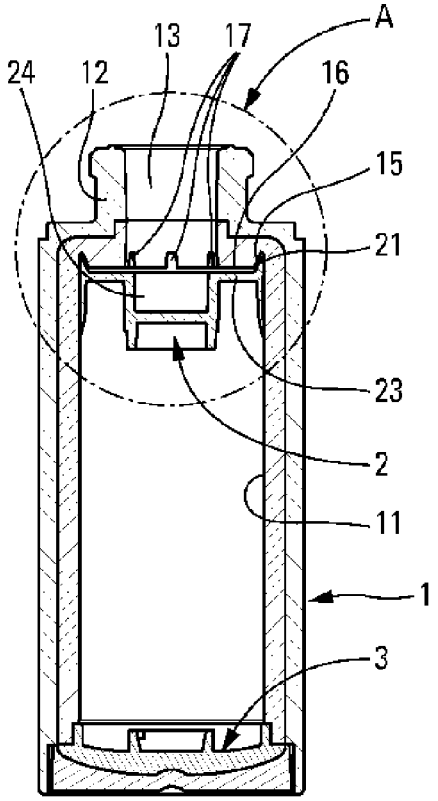
Figure 2A:
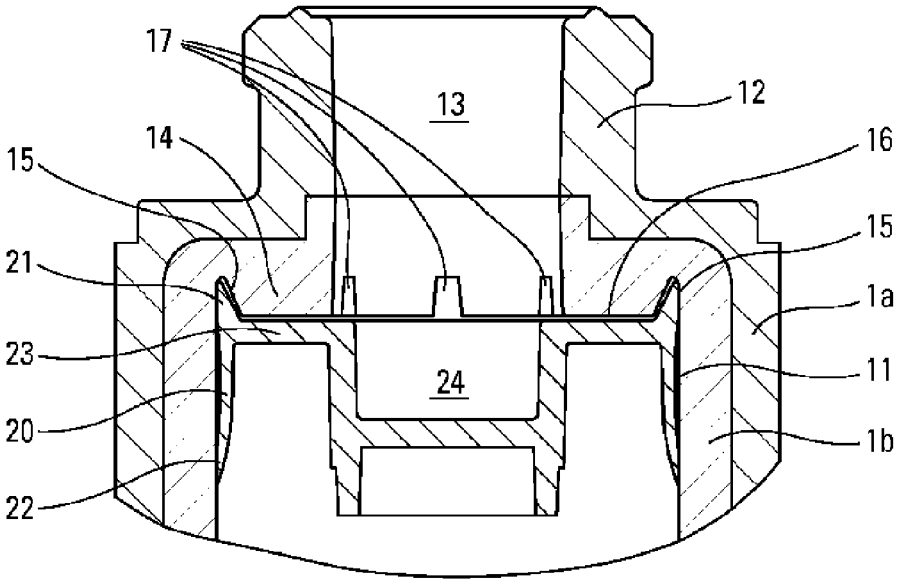

In the figures:

FIG. 1*a* is a vertical section view through a reservoir of the present invention with the follower piston in its low position;

FIG. 1*b* is a view similar to FIG. 1*a* with the follower piston in its high position;

FIG. 2*a* is a greatly enlarged view of the portion A in FIG. 1*b;*

Figure 2B:
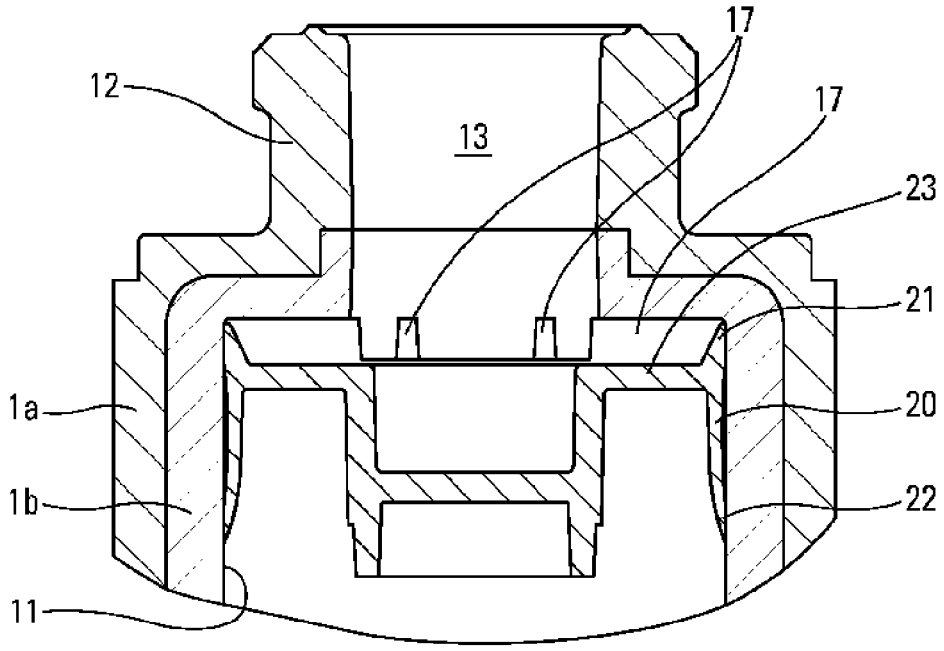
Figure 3:
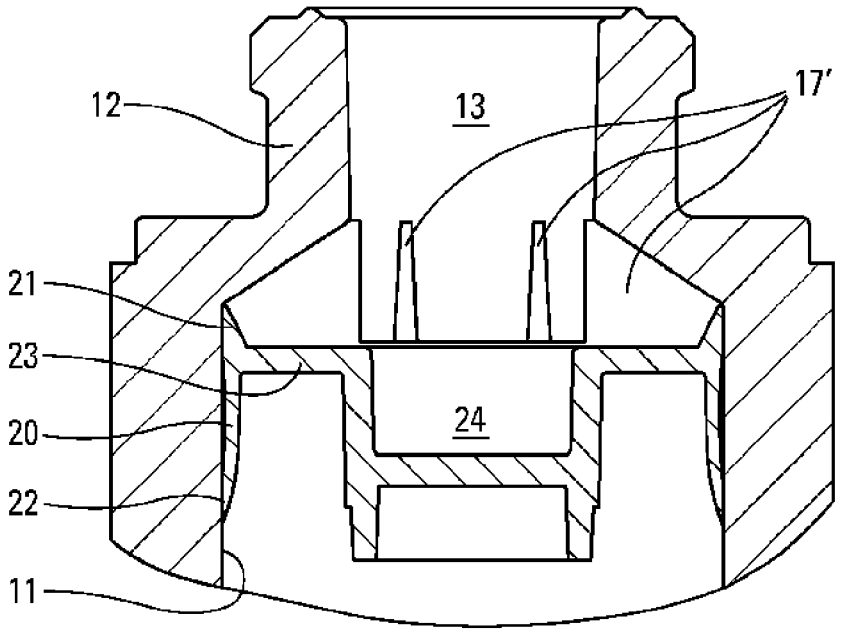

FIG. 2*b* is a view similar to the view in FIG. 2*a* on a different section plane; and FIG. 3 is a view similar to the view in FIG. 2*b* in a second embodiment of the invention.

Reference is made firstly to FIGS. 1*a* to 2*b* in order to describe the first embodiment of a follower-piston reservoir of the invention. The reservoir comprises three component elements, namely a reservoir body 1, a follower piston 2, and optionally a bottom wall 3. The three component elements may be made by injection-molding an appropriate plastics material. The reservoir body 1 may possibly be made out of glass, ceramic, or metal.

In this embodiment, the reservoir body 1 presents the distinctive feature of being constituted by two components, namely an external component 1*a* and an internal component 1*b*, with this being, in particular, for reasons of appearance. Specifically, the internal component 1*b* may be made out of an opaque material, while the external component 1*a* may be made out of a transparent material, such that the internal component 1*b* can be seen through the transparent external component 1*a*. By way of example, the external component 1*a* may be overmolded on the internal component 1*b*. The two components 1*a*, 1*b* co-operate with each other to form the reservoir body 1. In this context, the reservoir body can be thought of as forming an internal slide cylinder 11 of substantially or completely cylindrical shape. In this embodiment, the cylinder is formed by the inside wall of the internal component 1*b*. At its top end, the reservoir body 1 forms a shoulder 14 of substantially-annular shape that connects the slide cylinder 11 to an outlet opening 13, which opening, in this embodiment, is defined by a projecting neck 12. In this embodiment, the internal portion of the shoulder 14 is formed by the internal component 1*b*. The external portion of the shoulder is formed by the external portion 1*a* and said shoulder connects the outside wall of the reservoir body to the outside portion of the neck 12. The outlet opening 13 is formed in part by the internal component 1*b* and in part by the external component 1*a*. At its bottom end, the reservoir body 1 forms a plurality of steps making it possible to receive the bottom wall 3 in stationary and permanent manner.

The follower piston 2 is received inside the slide cylinder 11, in such a manner as to be capable of moving therein in leaktight manner. The follower piston 2 includes an outer skirt 20 that forms a top annular sealing lip 21 and a bottom annular sealing lip 22 that both slide in leaktight manner inside the cylinder 11. From the skirt 20, the follower piston 2 forms an annular disk 23 that extends inwards as far as a central cup 24 that forms a recess relative to the disk 23. In the configuration shown in FIG. 1*a*, the follower piston 2 is in its lowest position, the cup 24 being in contact with the bottom wall 3. Both annular sealing lips 21 and 22 are in contact with the slide cylinder 11. This configuration corresponds to the configuration in which the reservoir is filled to its maximum. Specifically, the volume of the reservoir above the follower piston 2 is at its maximum, while the volume defined below the follower piston 2 is at its minimum.

Although not shown, a dispenser member, such as an airless pump, is for mounting on the neck 12, so as to extend into the outlet opening 13 and be capable of taking the fluid stored in the reservoir. Each time the pump is actuated, a dose of fluid is dispensed and a dose of fluid is taken from the reservoir. This creates suction inside the reservoir that causes the follower piston 2 to move by suction towards the opening 13. When the follower piston 2 comes into contact with the shoulder 14, the reservoir presents a minimum volume. In FIG. 1*b*, it should be observed that the cup 24 of the follower piston is situated axially just below the outlet opening 13 so as to be capable of receiving the bottom portion of the dispenser member (pump).

According to the invention, where the shoulder 14 is connected to the top end of the slide cylinder 11, it forms an annular groove 15 in which the top sealing lip 21 of the follower piston 2 is received when the reservoir is empty, as shown in the FIGS. 1*b*, 2*a*, and 2*b*. It should even be observed that the shape of the annular groove 15, in cross-section, corresponds roughly or substantially to the shape of the top lip 21, in cross-section, such that a minimum dead volume exists in the groove 15 when it receives the lip 21. An annular collar 16 is thus formed between the annular groove 15 and the opening 13. The collar 16 is defined by the bottom wall of the shoulder 14. In addition, it is advantageous for the disk 23 to come into contact with, or into the direct proximity of, the collar 16. Thus, only very little fluid remains between the follower piston and the shoulder 14. In other words, the annular groove 15 enables the degree of restitution of the reservoir to be improved considerably.

According to another advantageous characteristic of the invention, a plurality of radial channels 17 are formed in the collar 16 of the shoulder 14: they radially interconnect the annular groove 15 and the outlet opening 13. This is clearly visible in FIG. 2*b*, which is a cross-section in a plane containing two opposite radial channels 17. In this non-limiting configuration, the collar 16 is provided with six radial channels 17. Without going beyond the ambit of the invention, a single radial channel could be provided. In FIG. 2*b*, it should also be observed that the bottoms of the channels 17 are in alignment with the bottom of the groove 15. Thus, there is no discontinuity or step or relief or hollow between the groove and the channels. In this first embodiment, the bottoms of the channels 17 are at the same axial height as the bottom of the groove 15 (near the top of the reservoir, since the channels and the groove open downwards).

With reference to the second embodiment shown in FIG. 3, it can be seen that the reservoir is made as a single piece. Furthermore, there can be seen another type of radial channel 17' having a bottom that is indeed connected in continuous manner to the bottom of the groove 15, but that extends in upwardly sloping manner so as to open out higher in the outlet opening 13. Although the cross-sections of the channels 17 are substantially trapezoidal in shape, the cross-sections of the channels 17 generally present a shape that is triangular.

In the invention, the function of the radial channels 17, 17' is to provide an exhaust path for any air that might be held captive inside the reservoir at the shoulder 14. Specifically, when a follower-piston reservoir is filled with a viscous fluid such as a cream, it is very difficult to fill the zone situated at the corner between the shoulder 14 and the cylinder 11, specifically at the annular groove 15. As a result, one or more pockets of air may form at this location and, during vacuum packaging, the volume of the pockets of air expands very quickly, which can cause fluid to rise suddenly in the outlet opening 13. Consequently, it is necessary to be able to exhaust the air from any pockets through the outlet opening, without the volume of said pockets expanding. The radial channels 17, 17' thus provide an exhaust passage that connects the zone in which pockets of air form directly to the outlet opening 13. Without the radial channels of the invention, the phenomenon of pockets of air forming would be further amplified as a result of the presence of the annular groove 15 that is situated precisely at the zone where pockets of air form. Thus, by connecting the annular groove directly to the outlet opening 13, the radial channels 17, 17' make it possible to guarantee that any air that might be held captive below the shoulder 14 is exhausted in full. In addition, as a result of their trapezoidal or triangular shape, the total combined volume of the channels is considerably reduced, thereby reducing the dead volume of the reservoir when it is empty. Specifically, the dead volume of the reservoir is mainly constituted by the volume of the channels 17 and of a portion of the cup 14, given that the disk 23 comes into contact with, or into the direct proximity of, the shoulder 14, and given that the groove 15 is filled practically completely by the top sealing lip 21.

By means of the invention, not only is the degree of restitution of the reservoir considerably increased by receiving the top lip of the follower piston in an annular reception groove of appropriate shape, but also any air that might be held captive in the reservoir at the annular groove is exhausted through radial channels that connect the groove to the outlet opening.

The invention claimed is:

1. A fluid reservoir comprising:

a slide cylinder;

a neck that defines an outlet opening;

an internal shoulder that connects the slide cylinder to the outlet opening, the internal shoulder being provided with an annular groove that extends in line with the slide cylinder, such that the internal shoulder defines an annular collar that connects the annular groove to the outlet opening; and a follower piston that is engaged to slide in leaktight manner in the slide cylinder, the piston defining at least one sealing lip that is received in the annular groove when the reservoir is empty;

the fluid reservoir being characterized in that the annular collar is formed with at least one radial channel extending in a radial direction from the annular groove to the outlet opening of the neck.

2. A reservoir according to claim 1, wherein the annular collar includes a plurality of radial channels.

3. A reservoir according to claim 1, wherein the annular groove and said at least one radial channel present respective bottoms that are connected together in continuous manner.

4. A reservoir according to claim 3, wherein the bottom of said at least one radial channel extends in sloping manner towards a high end of the annular groove, towards the outlet opening.

5. A reservoir according to claim 1, wherein said at least one radial channel presents a section that is trapezoidal or triangular.

6. A reservoir according to claim 1, wherein the follower piston includes a disk, the sealing lip projecting from the disk such that the disk is in contact with the annular collar when the sealing lip is received in the annular groove.

7. A reservoir according to claim 1, wherein the follower piston includes a central cup that extends substantially in register with the outlet opening of the neck, so as to receive a bottom portion of a pump or of a valve.

8. A reservoir according to claim 1, wherein the at least one sealing lip of the follower piston includes a top sealing lip and a bottom sealing lip for sliding in leaktight manner in the slide cylinder, the top sealing lip being received in the annular groove when the reservoir is empty.

9. A reservoir according to claim 1, wherein the annular groove presents a section of shape that is substantially similar to the shape of the sealing lip.

10. A fluid reservoir comprising:

a slide cylinder having an internal shoulder, the internal shoulder comprising an annular groove;

a neck having an outlet opening; and a follower piston configured to slide in leaktight manner in the slide cylinder, the piston having at least one sealing lip configured to be received in the annular groove when the reservoir is empty, wherein the internal shoulder of the slide cylinder is connected to the outlet opening, and the internal shoulder including at least one radial channel extending in a radial direction from the annular groove to the outlet opening.

11. The fluid reservoir according to claim 10, wherein the annular groove extends along the slide cylinder.

* * * * *